US012251029B1

(12) United States Patent
Jin

(10) Patent No.: US 12,251,029 B1
(45) Date of Patent: Mar. 18, 2025

(54) SOFA ARMREST FOLDING MECHANISM AND SOFA ARMREST

(71) Applicant: GENOVA INC, Diamond Bar, CA (US)

(72) Inventor: Jiachen Jin, Diamond Bar, CA (US)

(73) Assignee: GENOVA INC, Diamond Bar, CA (US)

( * ) Notice: Subject to any disclaimer, the term of this patent is extended or adjusted under 35 U.S.C. 154(b) by 0 days.

(21) Appl. No.: 18/898,723

(22) Filed: Sep. 27, 2024

(51) Int. Cl.

| | |
|---|---|
| ***A47C 7/54*** | (2006.01) |
| ***A47C 4/28*** | (2006.01) |
| ***A47C 17/04*** | (2006.01) |
| ***A47C 17/86*** | (2006.01) |

(52) U.S. Cl.
CPC ..... *A47C 7/543* (2013.01); *A47C 4/283* (2013.01); *A47C 7/546* (2013.01); *A47C 17/04* (2013.01); *A47C 17/86* (2013.01)

(58) Field of Classification Search
CPC ..... A47C 7/543; A47C 4/283; A47C 7/546; A47C 17/04; A47C 17/86
USPC ..... 297/411.3, 411.23, 440.1, 440.14, 183.1
See application file for complete search history.

(56) References Cited

U.S. PATENT DOCUMENTS

| | | | | |
|---|---|---|---|---|
| 9,028,016 | B2 * | 5/2015 | Glenn, Jr. | A47B 43/00 312/257.1 |
| 11,707,138 | B1 * | 7/2023 | Wu | A47C 7/546 5/12.1 |
| 12,121,156 | B1 * | 10/2024 | Wu | A47C 17/86 |
| 12,144,432 | B1 * | 11/2024 | Chen | A47C 4/045 |
| 2005/0217713 | A1 * | 10/2005 | Chu | E04H 15/48 135/144 |
| 2007/0079858 | A1 * | 4/2007 | Chu | A63H 33/008 135/136 |
| 2014/0299596 | A1 * | 10/2014 | Kochanowski | B65D 88/524 220/1.5 |
| 2024/0382006 | A1 * | 11/2024 | Lei | A47C 17/86 |
| 2024/0415288 | A1 * | 12/2024 | Yuan | A47C 7/543 |

FOREIGN PATENT DOCUMENTS

| | | | |
|---|---|---|---|
| CN | 205625337 | U | 10/2016 |

* cited by examiner

*Primary Examiner* — Robert Canfield
(74) *Attorney, Agent, or Firm* — Bayramoglu Law Offices LLC

(57) ABSTRACT

A sofa armrest folding mechanism and a sofa armrest are provided. The sofa armrest folding mechanism includes: side boards, a handle, and folding devices, where the side boards are connected to two sides of the folding devices, respectively; two ends of the handle are connected to top ends of the folding devices, respectively; the folding devices switch between a folded state and an unfolded state through the handle; when the handle is pulled upwards, the folding devices are in the folded state; and when the handle is pushed downwards, the folding devices are in the unfolded state. Connecting teeth on each two adjacent connecting rods are engaged, and the handle is pulled upwards or pushed downwards to drive the side boards to move close to or away from each other, achieving a change in the overall structural state.

18 Claims, 7 Drawing Sheets

SOFA ARMREST FOLDING MECHANISM AND SOFA ARMREST

TECHNICAL FIELD

The present disclosure relates to the field of foldable furniture, and in particular to a sofa armrest folding mechanism and a sofa armrest.

BACKGROUND

Traditional sofa armrests use fixed wooden frames, which take up a large amount of space. However, this structure ensures sofa flatness, reducing the space occupied by transportation packaging and transportation costs.

According to search results, Chinese utility model patent CN205625337U discloses a folding sofa bed frame and a folding sofa bed. The folding sofa bed frame includes a bottom cushion holder. Two side ends of the bottom cushion holder are hinged to the middle parts of a first rotating frame and a second rotating frame, respectively. The bottom ends of the first rotating frame and the second rotating frame are hinged to two ends of a connecting frame, respectively. The top ends of the first rotating frame and the second rotating frame are hinged to the two side ends of a top cushion holder, respectively. The surface of the bottom cushion holder is parallel to the surface of the top cushion holder. When the first rotating frame and the second rotating frame connected by the connecting frame are flipped downwards, the top cushion holder translates in an arc direction until it is at the same level as the bottom cushion holder. When the first rotating frame and the second rotating frame connected by the connecting frame are flipped upwards, the top cushion holder translates in an arc direction until it is located above the bottom cushion holder. However, this patent does not solve the problem of the occupied space of sofa armrests being large.

SUMMARY

In view of the defects in the prior art, an objective of the present disclosure is to provide a sofa armrest folding mechanism and a sofa armrest.

The present disclosure provides a sofa armrest folding mechanism, including: side boards, a handle, and folding devices, where the side boards are connected to two sides of the folding devices, respectively; two ends of the handle are connected to top ends of the folding devices, respectively; and the folding devices switch between a folded state and an unfolded state through the handle;

when the handle is pulled upwards, the folding devices are in the folded state; and when the handle is pushed downwards, the folding devices are in the unfolded state.

Preferably, the folding device includes connecting irons, connecting rods, a fixing element, and gears; the handle is located at an upper side of the fixing element; the fixing element is connected to the gears; the gear is movably connected to one end of the connecting rod; the other end of the connecting rod is movably connected to the connecting iron; and the connecting iron is connected to the side board.

Preferably, each two adjacent gears are engaged, and the gears are respectively connected to the connecting rods.

Preferably, the one end of the connecting rod is provided with connecting teeth, and the connecting teeth of each two adjacent connecting rods are engaged.

Preferably, the fixing element includes a first mounting element, a second mounting element, and a connecting shaft; the first mounting element is integrally connected to the second mounting element through the connecting shaft; and an upper side of the first mounting element is provided with a mounting hole; an end of the handle is fixedly connected to the first mounting element through the mounting hole.

Preferably, a lower side of the first mounting element and the second mounting element are respectively provided with the gears.

Preferably, each two adjacent connecting irons are axially symmetrical and respectively connected to two sides of the fixing element.

Preferably, the connecting iron is in an L-shape.

Preferably, the connecting iron includes a first mounting iron and a second mounting iron; the first mounting iron is vertically connected to two ends of the second mounting iron; and the second mounting iron is in a U-shape; and the first mounting iron is movably connected to the other end of the connecting rod;

and the second mounting iron is fixedly provided on the side board.

The present disclosure further provides a sofa armrest, including the sofa armrest folding mechanism and an outer skin, where the outer skin is adapted and connected to the sofa armrest folding mechanism; and a top of the outer skin is provided with an opening; the opening is correspondingly connected to the handle; and a zipper is provided around a bottom of the outer skin.

Compared with the prior art, the present disclosure has the following beneficial effects:

In the present disclosure, the connecting teeth on each two adjacent connecting rods are engaged, and the handle is pulled upwards or pushed downwards to drive the side boards to move close to or away from each other, achieving a change in the overall structural state. The use of the folding devices reduces transportation packaging space and transportation costs while ensuring overall structural flatness.

BRIEF DESCRIPTION OF THE DRAWINGS

Other features, objectives, and advantages of the present disclosure will become more apparent by reading the detailed description of non-limiting embodiments with reference to the following drawings.

FIG. 5A is a front view; and FIG. 5B is a rear view;

FIG. 6A is a front view; and FIG. 6B is a rear view.

Figure 1:
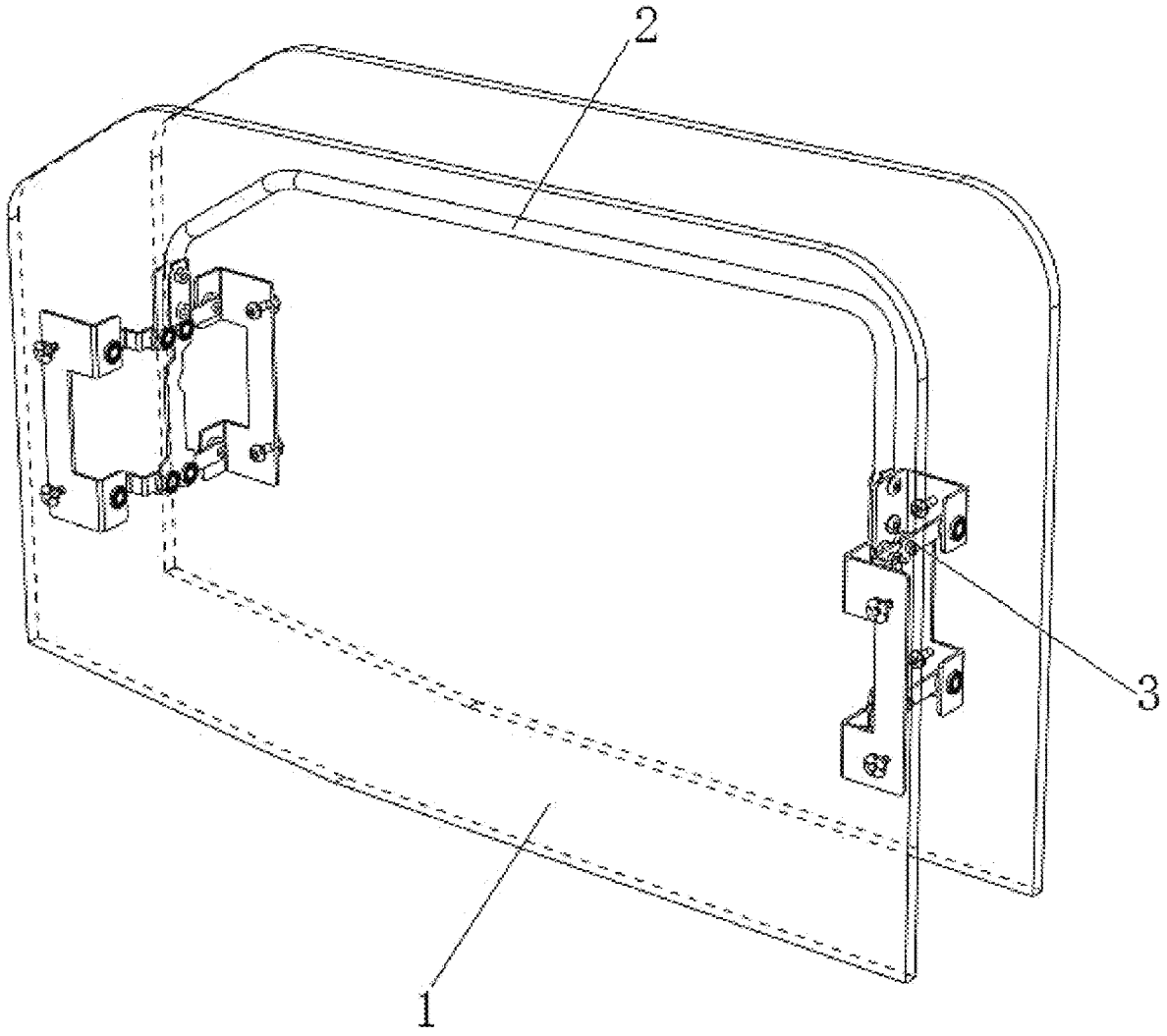
FIG. 1 is a structural diagram of a sofa armrest folding mechanism in an unfolded state according to the present disclosure.
Figure 2:
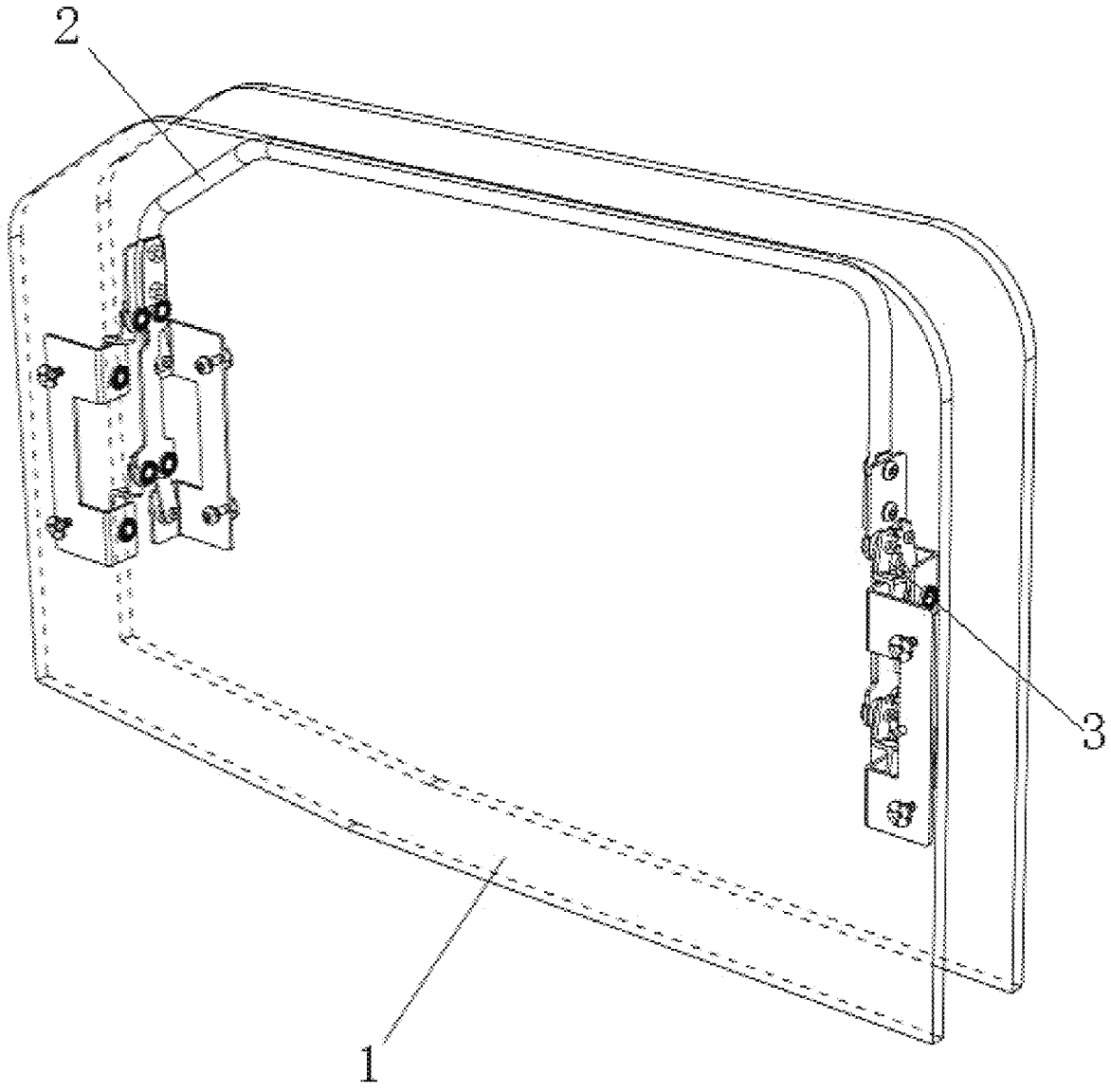
FIG. 2 is a structural diagram of the sofa armrest folding mechanism in the unfolded state according to the present disclosure.
Figure 3:
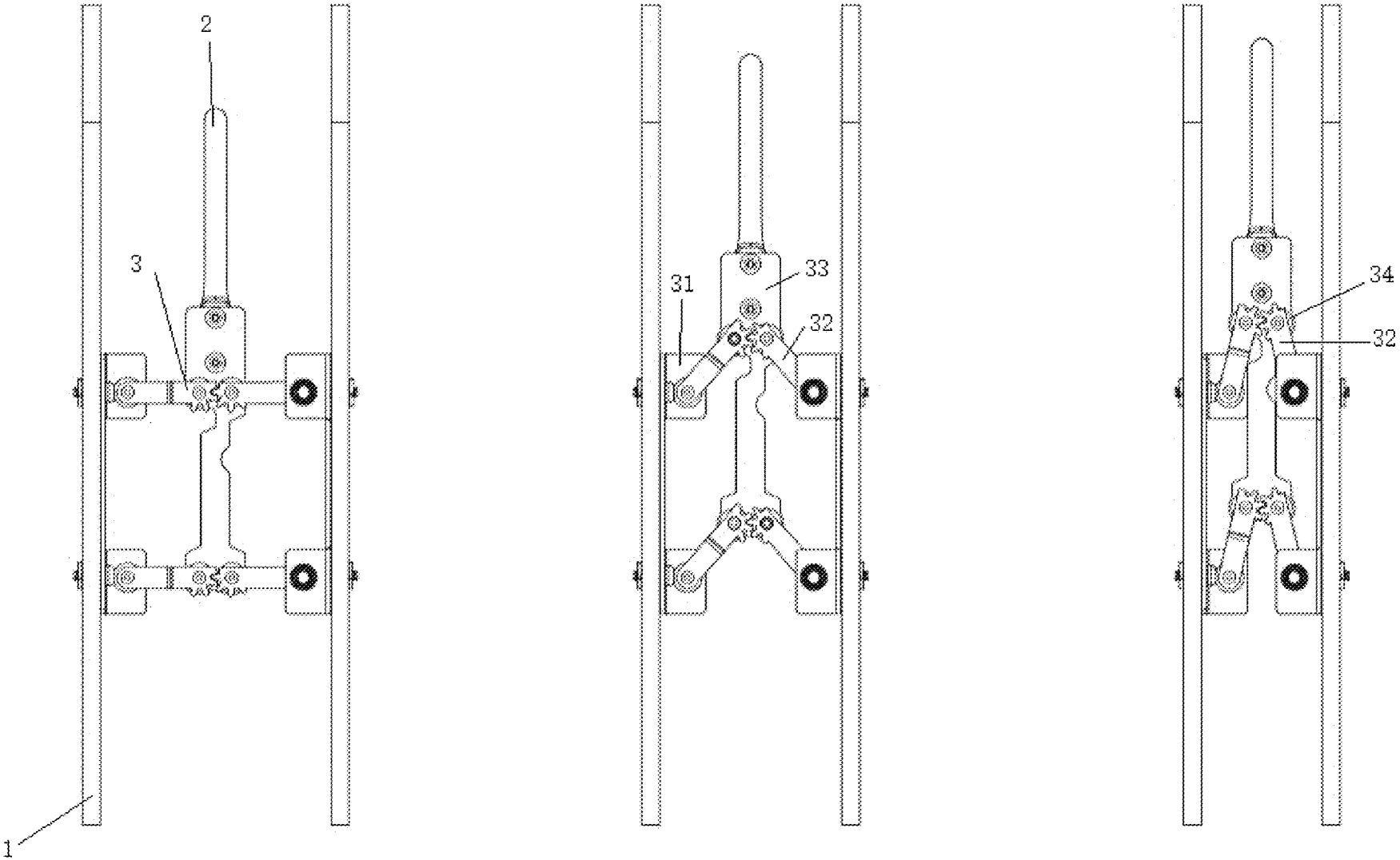
FIG. 3 shows a lateral view comparison of structural states of the sofa armrest folding mechanism according to the present disclosure.
Figure 4:
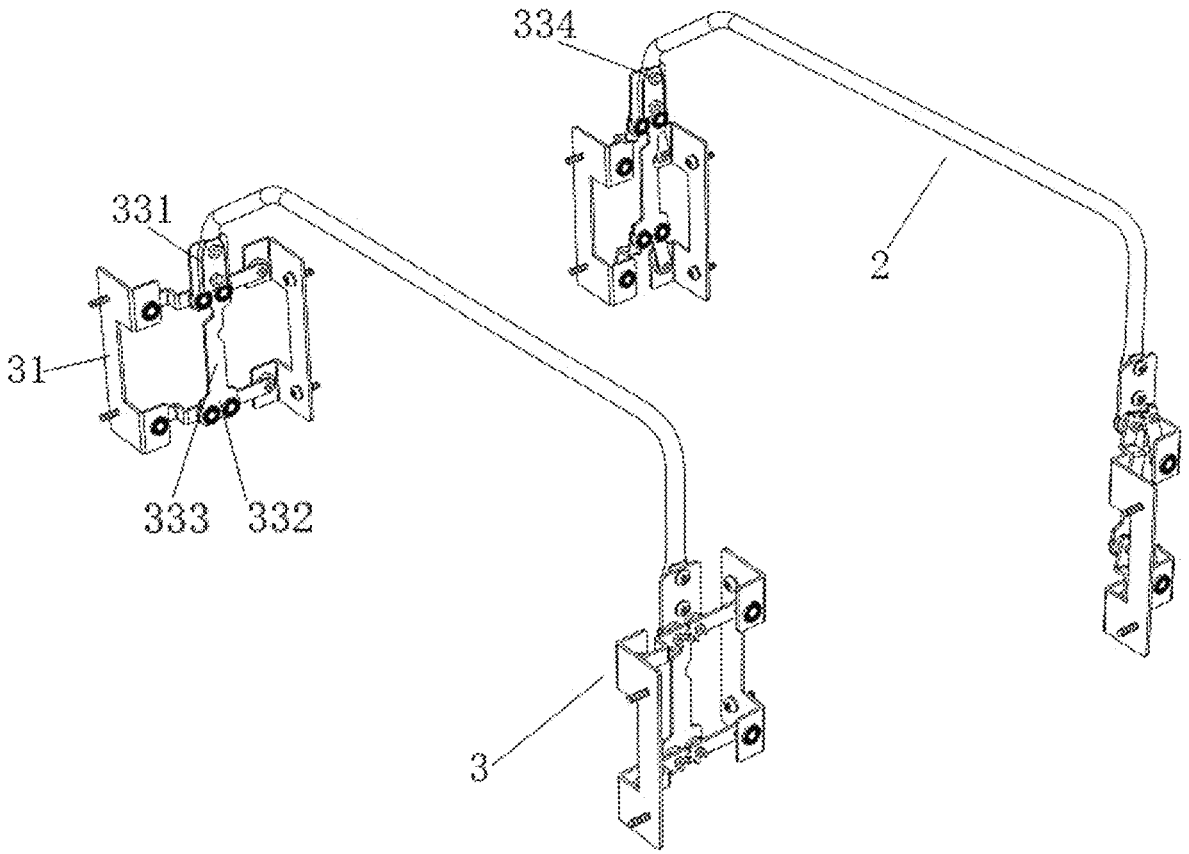
FIG. 4 shows a comparison of states of folding devices connected to a handle according to the present disclosure.
Figure 5B:
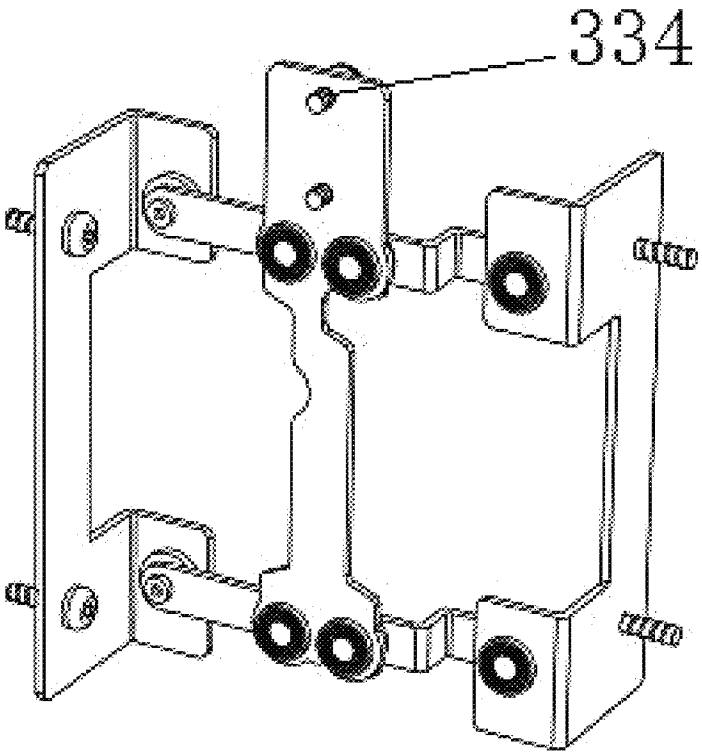
FIGS. 5A and 5B show a structural diagram of the folding device in an unfolded state according to the present disclosure, where
Figure 5A:
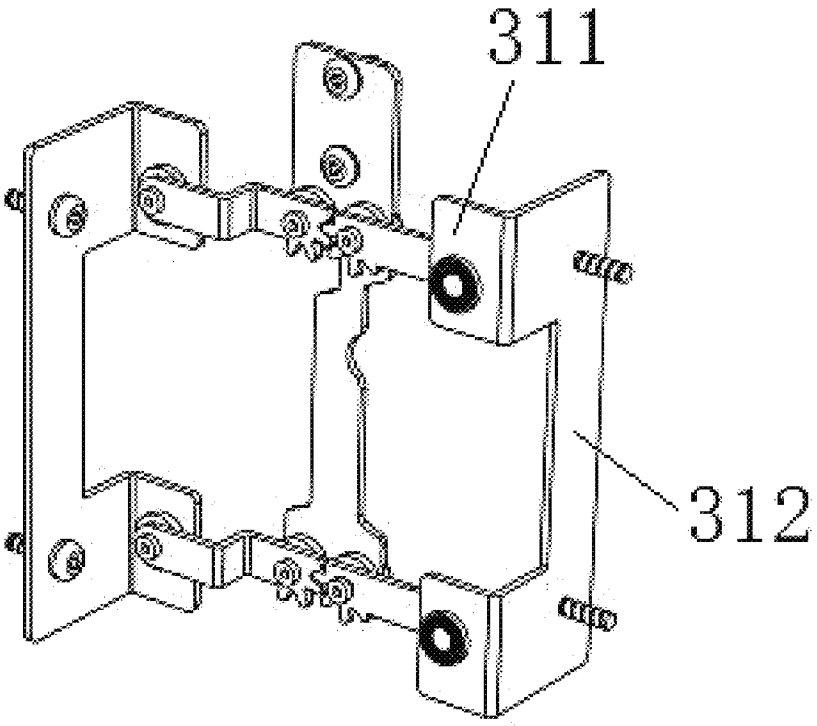
Figure 6B:
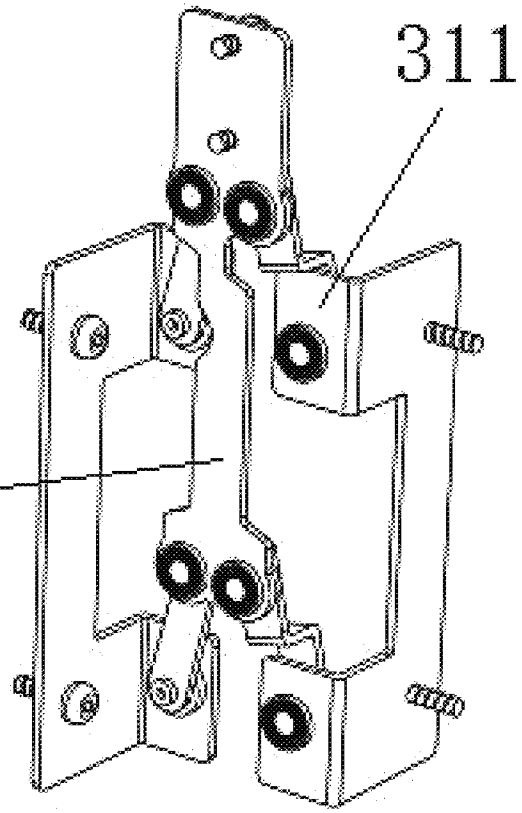
FIGS. 6A and 6B show a structural diagram of the folding device in a folded state according to the present disclosure, where
Figure 6A:
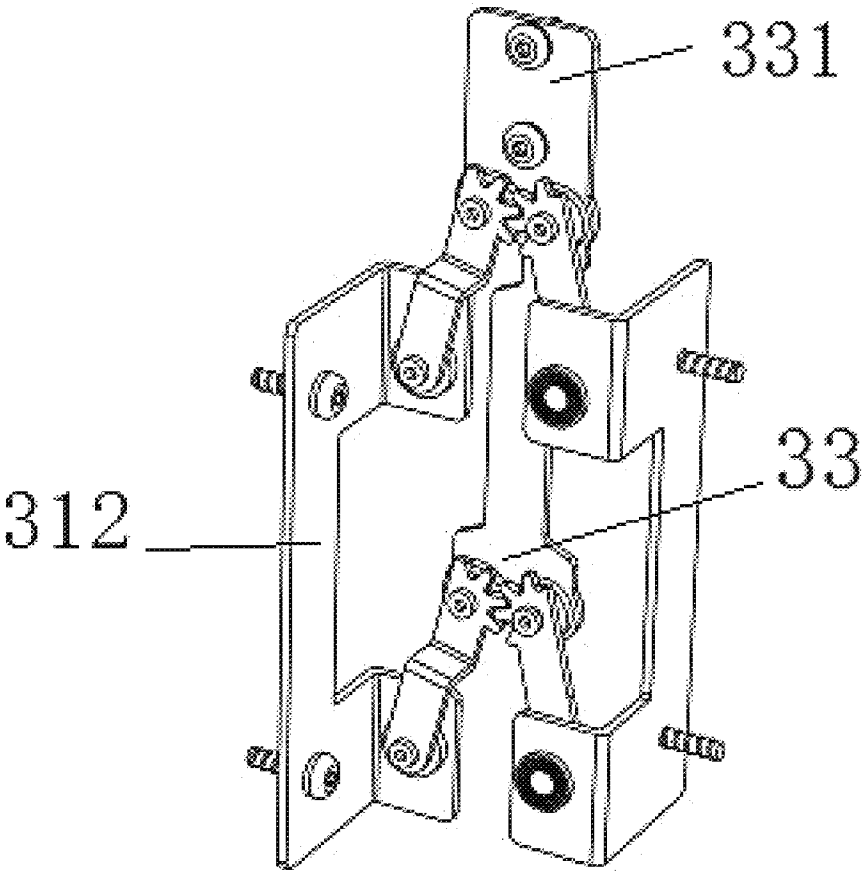

Reference Numerals: 1. side board; 2. handle; 3. folding device; 31. connecting iron; 311. first mounting iron; 312. second mounting iron; 32. connecting rod; 33. fixing element; 331. first mounting element; 332. second mounting element; 333. connecting shaft; and 34. gear.

DETAILED DESCRIPTION OF THE EMBODIMENTS

The following describes the present disclosure in detail in conjunction with particular embodiments. The following embodiments will be conducive to further understanding of the present disclosure by a person of ordinary skill in the art, but does not limit the present disclosure in any form. It should be noted that several variations and improvements can also be made by a person of ordinary skill in the art without departing from the conception of the present disclosure. These variations and improvements shall fall within the protection scope of the present disclosure.

Embodiment 1

The present disclosure provides a sofa armrest folding mechanism. As shown in FIGS. 1 to 4, 5A-5B, and 6A-6B, the sofa armrest folding mechanism includes: side boards 1, handle 2, and folding devices 3. The side boards 1 are connected to two sides of the folding devices 3, respectively. Two ends of the handle 2 are connected to top ends of the folding devices 3, respectively. When the handle 2 is pulled upwards and pushed downwards, the folding devices 3 switch between a folded state and an unfolded state, thereby reducing packaging space.

The folding device 3 includes connecting irons 31, connecting rods 32, fixing element 33, and gears 34. The connecting irons 31 each are in an L-shape. Two adjacent connecting irons 31 are axially symmetrical and respectively connected to two sides of the fixing element 33. The connecting irons 31 are connected to the side boards 1, respectively. The fixing element 33 includes first mounting element 331, second mounting element 332, and connecting shaft 333. The first mounting element 331 is integrally connected to the second mounting element 332 through the connecting shaft 333. An upper side of the first mounting element 331 is provided with mounting hole 334. An end of the handle 2 is fixedly connected to the upper side of the first mounting element 331 through a bolt that cooperates with the mounting hole 334. A lower side of the first mounting element 331 and the second mounting element 332 each are provided with two gears 34 that are engaged. The gear 34 is movably connected to an end of the corresponding connecting rod 32. The end of the connecting rod 32 is provided with connecting teeth, and the connecting teeth of each two adjacent connecting rods 32 are engaged.

The connecting iron 31 includes first mounting iron 311 and second mounting iron 312. The first mounting iron 311 is vertically connected to two ends of the second mounting iron 312. The second mounting iron is in a U-shape for easy placement of the connecting rods folded. The first mounting iron 311 is movably connected to the other end of the connecting rod 32. The second mounting iron 312 is fixedly provided on the side board 1.

When the handle 2 is pulled upwards, the folding devices 3 are in the folded state. By pulling, the connecting teeth are rotated, and the connecting rods 32 drive the connecting irons 31 towards a center. Thus, the central distance between the two side boards 1 is reduced.

When the handle 2 is pushed downwards, the folding devices 3 are in the unfolded state. By pushing, the connecting rods 32 drive the connecting irons 31 to unfold towards two sides, thereby increasing the distance between the two wooden boards.

Embodiment 2

Figure 7:
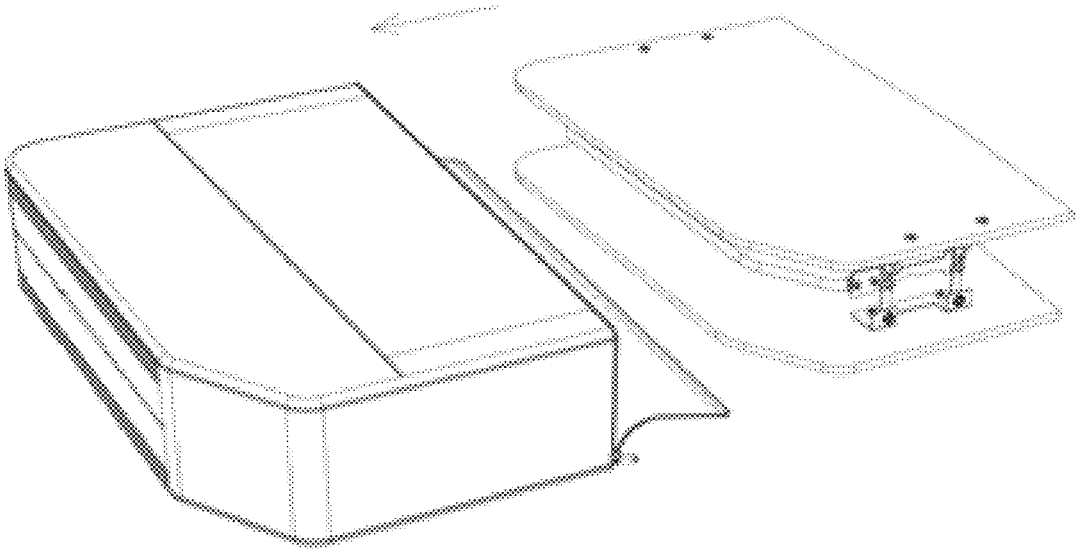
FIG. 7 is a structural diagram according to Embodiment 2 of the present disclosure.

The present disclosure further provides a sofa armrest. As shown in FIG. 7, the sofa armrest includes the sofa armrest folding mechanism in Embodiment 1 and an outer skin. The outer skin is adapted and connected to the sofa armrest folding mechanism.

A top of the outer skin is provided with an opening. The opening is correspondingly connected to the handle 2. The user can reach his/her hand into the outer skin to pull the handle 2 upwards for a folding purpose or push the handle 2 downwards for an unfolding purpose. A zipper is provided around a bottom of the outer skin. After the zipper is opened, the sofa armrest folding mechanism is put into the outer skin, and then the zipper is closed for sealing.

In the description of the present disclosure, it needs to be understood the orientation or positional relationships indicated by terms, such as "up", "down", "front", "rear", "left", "right", "vertical", "horizontal", "top", "bottom", "inside", and "outside", are based on the orientation or positional relationship shown in the drawings, are merely for facilitating the description of the present disclosure and simplifying the description, rather than indicating or implying that an apparatus or element referred to must have a particular orientation or be constructed and operated in a particular orientation, and therefore shall not be interpreted as limiting the present disclosure.

The specific embodiments of the present disclosure are described as above. It should be understood that the present disclosure is not limited to the above specific embodiments. Those skilled in the art can make various changes or modifications within the scope of the claims, which does not affect the essence of the present disclosure. The embodiments of the present disclosure and features in the embodiments may be arbitrarily combined with each other in a non-conflicting situation.

What is claimed is:

1. A sofa armrest folding mechanism, comprising: side boards, a handle, and folding devices, wherein the side boards are connected to two sides of the folding devices, respectively; two ends of the handle are connected to top ends of the folding devices, respectively; and the folding devices switch between a folded state and an unfolded state through the handle;

when the handle is pulled upwards, the folding devices are in the folded state; and when the handle is pushed downwards, the folding devices are in the unfolded state.

2. The sofa armrest folding mechanism according to claim 1, wherein the folding devices comprise connecting irons, connecting rods, a fixing element, and gears; the handle is located at an upper side of the fixing element; the fixing element is connected to the gears; each of the gears is movably connected to a first end of a corresponding connecting rod of the connecting rods; a second end of the corresponding connecting rod is movably connected to a corresponding connecting iron of the connecting irons; and the corresponding connecting iron is connected to a corresponding side board of the side boards.

3. The sofa armrest folding mechanism according to claim 2, wherein adjacent pairs of the gears are engaged, and the gears are respectively connected to the connecting rods.

4. The sofa armrest folding mechanism according to claim 3, wherein the first ends of the connecting rods are provided with connecting teeth which forms the gears, and the connecting teeth of adjacent pairs of the connecting rods are engaged.

5. The sofa armrest folding mechanism according to claim 2, wherein the fixing element comprises a first mounting element, a second mounting element, and a connecting shaft; the first mounting element is integrally connected to the second mounting element through the connecting shaft; and an upper side of the first mounting element is provided with a mounting hole; an end of the handle is fixedly connected to the first mounting element through the mounting hole.

6. The sofa armrest folding mechanism according to claim 5, wherein a lower side of the first mounting element and the second mounting element are respectively provided with the gears.

7. The sofa armrest folding mechanism according to claim 1, wherein adjacent pairs of the connecting irons are axially symmetrical and respectively connected to two sides of the fixing element.

8. The sofa armrest folding mechanism according to claim 2, wherein each of the connecting irons is in an L-shape.

9. The sofa armrest folding mechanism according to claim 8, wherein each of the connecting irons comprises a first mounting iron and a second mounting iron; the first mounting iron is vertically connected to two ends of the second mounting iron; and the second mounting iron is in a U-shape; and the first mounting iron is movably connected to a second end of a corresponding connecting rod of the connecting rods; and the second mounting iron is fixedly provided on a corresponding side board of the side boards.

10. A sofa armrest, comprising the sofa armrest folding mechanism according to claim 1 and an outer skin, wherein the outer skin is adapted to be connected to the sofa armrest folding mechanism; and a top of the outer skin is provided with an opening; the opening is correspondingly connected to the handle; and a zipper is provided around a bottom of the outer skin.

11. The sofa armrest according to claim 10, wherein in the sofa armrest folding mechanism, the folding devices comprise connecting irons, connecting rods, a fixing element, and gears; the handle is located at an upper side of the fixing element; the fixing element is connected to the gears; each of the gears is movably connected to a first end of a corresponding connecting rod of the connecting rods; a second end of the corresponding connecting rod is movably connected to a corresponding connecting iron of the connecting irons; and the corresponding connecting iron is connected to a corresponding side board of the side boards.

12. The sofa armrest according to claim 11, wherein in the sofa armrest folding mechanism, adjacent pairs of the gears are engaged, and the gears are respectively connected to the connecting rods.

13. The sofa armrest according to claim 12, wherein in the sofa armrest folding mechanism, the first ends of the connecting rods are provided with connecting teeth which forms the gears, and the connecting teeth of adjacent pairs of the connecting rods are engaged.

14. The sofa armrest according to claim 11, wherein in the sofa armrest folding mechanism, the fixing element comprises a first mounting element, a second mounting element, and a connecting shaft; the first mounting element is integrally connected to the second mounting element through the connecting shaft; and an upper side of the first mounting element is provided with a mounting hole; an end of the handle is fixedly connected to the first mounting element through the mounting hole.

15. The sofa armrest according to claim 14, wherein in the sofa armrest folding mechanism, a lower side of the first mounting element and the second mounting element are respectively provided with the gears.

16. The sofa armrest according to claim 10, wherein in the sofa armrest folding mechanism, adjacent pairs of the connecting irons are axially symmetrical and respectively connected to two sides of the fixing element.

17. The sofa armrest according to claim 11, wherein in the sofa armrest folding mechanism, each of the connecting irons is in an L-shape.

18. The sofa armrest according to claim 17, wherein in the sofa armrest folding mechanism, each of the connecting irons comprises a first mounting iron and a second mounting iron; the first mounting iron is vertically connected to two ends of the second mounting iron; and the second mounting iron is in a U-shape; and the first mounting iron is movably connected to a second end of a corresponding connecting rod of the connecting rods; and the second mounting iron is fixedly provided on a corresponding side board of the side boards.

* * * * *